US007875579B2

(12) United States Patent
Chase et al.

(10) Patent No.: US 7,875,579 B2
(45) Date of Patent: Jan. 25, 2011

(54) LUBRICANT ANTIOXIDANT COMPOSITIONS CONTAINING A METAL COMPOUND AND A HINDERED AMINE

(75) Inventors: Kevin J. Chase, Brandford, CT (US); John M. DeMassa, Trumbull, CT (US); Brian W. Stunkel, Stamford, CT (US); Glenn A. Mazzamaro, Ridgefield, CT (US); Steven G. Donnelly, Bethel, CT (US)

(73) Assignee: R.T. Vanderbilt Company, Inc., Norwalk, CT (US)

( * ) Notice: Subject to any disclaimer, the term of this patent is extended or adjusted under 35 U.S.C. 154(b) by 226 days.

(21) Appl. No.: 12/041,317

(22) Filed: Mar. 3, 2008

(65) Prior Publication Data

US 2008/0221000 A1 Sep. 11, 2008

Related U.S. Application Data

(60) Provisional application No. 60/893,195, filed on Mar. 6, 2007, provisional application No. 60/944,897, filed on Jun. 19, 2007.

(51) Int. Cl.
*C10M 141/10* (2006.01)
*C10M 163/00* (2006.01)
*C10M 137/10* (2006.01)

(52) U.S. Cl. ..... 508/364; 508/365; 508/379

(58) Field of Classification Search ..... 508/167, 508/364, 365, 379
See application file for complete search history.

(56) References Cited

U.S. PATENT DOCUMENTS 4,529,526 A * 7/1985 Inoue et al. ..... 508/192
4,889,647 A * 12/1989 Rowan et al. ..... 508/367
5,073,278 A 12/1991 Schumacher
5,198,130 A 3/1993 Schumacher
5,204,473 A 4/1993 Winter et al.
5,268,113 A * 12/1993 Evans ..... 508/262
5,273,669 A 12/1993 Schumacher
5,703,023 A * 12/1997 Srinivasan ..... 508/468
5,994,277 A 11/1999 Ritchie
6,306,802 B1 10/2001 Shaub
6,797,677 B2 * 9/2004 Esche et al. ..... 508/167
RE38,929 E 1/2006 Gatto et al.
7,615,520 B2 11/2009 Esche, Jr.
7,727,943 B2 6/2010 Brown et al.
2003/0134754 A1 7/2003 Kelley
2004/0214731 A1 10/2004 Tynik
2006/0035791 A1 2/2006 Donnelly et al.
2007/0042917 A1 2/2007 Ravichandran
2008/0051306 A1 2/2008 Chasan et al.

* cited by examiner

*Primary Examiner*—Walter D Griffin
*Assistant Examiner*—Frank C Campanell
(74) *Attorney, Agent, or Firm*—Norris McLaughlin & Marcus, P.A.

(57) ABSTRACT

An antioxidant lubricant composition has at least 50 wt % of a lubricating base oil and an oil-soluble metal compound providing between 1 and 2,000 parts per million of metal to the lubricant composition, the metal compound being chosen from the group consisting of molybdenum, tungsten titanium and boron compounds, and an oil-soluble hindered amine providing between about 0.001 and about 2 wt % of oil-soluble hindered amine to the lubricant composition, and optionally, an oil-soluble diarylamine providing between 0.001 and about 2 wt % of oil-soluble diarylamine to the lubricant composition.

15 Claims, No Drawings

LUBRICANT ANTIOXIDANT COMPOSITIONS CONTAINING A METAL COMPOUND AND A HINDERED AMINE

This application is a non-provisional application claiming benefit under 35 U.S.C. 119(e) of U.S. Ser. Nos. 60/893,195, filed Mar. 6, 2007 and 60/944,897 filed Jun. 19, 2007.

BACKGROUND OF THE INVENTION

1. Field of the Invention

This invention relates to lubricating oil compositions, their method of preparation and use. Specifically, this invention relates to lubricating compositions that contain a metal compound and a hindered amine. The use of a metal compound and the hindered amine act synergistically to surprisingly provide protection of the lubricant from oxidation. The addition of an aromatic amine, particularly a diarylamine, to this combination provides even better protection.

2. Description of the Related Art

Oxidation is a major cause of the breakdown of lubricants. This results in a shortened lifespan of the lubricant, requiring more frequent changes, especially in demanding environments such as internal combustion engines.

Antioxidants have therefore played an important role as additives in lubricants in order to extend their useful life. Aromatic amines, especially secondary diarylamines, e.g., alkylated diphenylamines, phenothiazines, and alkylated N-naphthyl-N-phenylamines, have been important additives to lubricating compositions. Also important have been phenolic compounds in retarding oxidation.

The combination of an antioxidant with a metal compound has been important in extending the lifetime of the antioxidant. For example, U.S. Pat. No. 5,994,277 to Richie et al. teaches that a crankcase lubricant composition which contains copper, molybdenum and aromatic amines can act as an effective antioxidant combination. U.S. Pat. No. 6,306,802 to Shaub et al. discloses sulfurized molybdenum complexes with oil-soluble aromatic amines. Gatto, et al., in U.S. Pat. No. RE38,929E has disclosed that the combination of certain sulfur and phosphorus-free molybdenum compounds and secondary diarylamines improved the useful life of a lubricating oil. The most effective amounts in inhibiting oxidation were between 100 and 450 parts per million (ppm) of molybdenum, and between 750 and 5,000 ppm of an oil-soluble secondary diphenylamine.

Other combinations of antioxidants have also been used. U.S. Pat. Nos. 5,073,278 and 5,273,669 to Schumacher et al. disclose the synergistic combination of aromatic amines and hindered amines in a lubricating oil. U.S. Pat. No. 5,268,113 to Evans et al. discloses the combination of a hindered amine with phenolic compounds.

SUMMARY OF THE INVENTION

We have found that a lubricant composition containing the combination of a metal compound with a hindered amine gives antioxidant protection in a synergistic fashion.

We have also discovered that a lubricant composition containing the combination of a metal compound with a hindered amine and a secondary diarylamine can synergistically give enhanced antioxidant protection.

DETAILED DESCRIPTION OF THE INVENTION

The invention provides a lubricant composition which comprises (a) a mineral or a synthetic base oil or a mixture of such oils (b) at least one oil soluble metal compound providing between 1 and 2,000 parts per million of metal, preferably about 50 to 750 ppm metal where the metal is molybdenum or tungsten, and more preferably about 125 to 700 ppm metal.

(c) at least one hindered amine providing between about 0.001-2 wt %, preferably about 0.5-1.5 wt % hindered amine to the lubricant composition The invention also provides a lubricant composition which comprises (a) a mineral or a synthetic base oil or a mixture of such oils (b) at least one oil soluble metal compound providing between 1 and 2,000 parts per million of metal, preferably about 50 to 750 ppm metal where the metal is molybdenum or tungsten, and more preferably about 125 to 700 ppm metal.

(c) at least one hindered amine providing between about 0.001-2 wt %, preferably about 0.5-1.5 wt % hindered amine to the lubricant composition (d) at least one aromatic amine (diaryl amine) providing between about 0.001-2 wt %, preferably about 0.5-1.5 wt % aromatic amine to the lubricant composition

Lubricant Basestocks

Typical lubricant basestocks can include both mineral and synthetic oils. Included are polyalphaolefins, (also known as PAOS), esters, diesters and polyol esters or mixtures thereof. The lubricant basestock, which can be one or more in combination of a mineral or synthetic oil as described herein, is present in the lubricating composition as a major portion thereof, i.e. at least 50% by weight.

Molybdenum Compound

The molybdenum compound used in this invention can be any lubricant-soluble molybdenum compound. Examples are listed below. This list is not to imply any limitation on the type of lubricant-soluble molybdenum compound, but is shown as an example of possible useful molybdenum compounds.

(1) Molybdenum dithiocarbamate compounds, of the generalized structure (I):

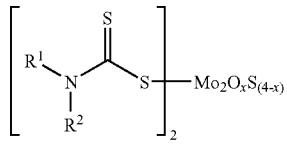

(I)

where x=0 to 4

Where ($R^1R^2NCS_2$) is a dithiocarbamate (DTC) where $R^1$ and $R^2$ is a hydrocarbon containing from 1 to 25 carbon atoms or $R^1$ and $R^2$ is a hydrocarbon with an ether linkage(s) containing from 1 to 5 oxygen atoms and 1 to 25 carbon atoms. $R^1$ and $R^2$ can be the same or different.

Commercial examples of such dithiocarbamate compounds are MOLYVAN® 822, MOLYVAN® 807, and MOLYVAN® 2000 (sold by the R.T. Vanderbilt Company), Sakuralube® 515, Sakuralube® 200 (sold by the Adeka Company). In these examples the R group is either a $C_8$ saturated alkyl or a $C_{13}$ saturated alkyl or a mixture of the two.

(2) Molybdenum trinuclear dithiocarbamate compounds such as reported by Steifel et. al in U.S. Pat. No. 5,888, 945. These compounds have generalized formulas (II) and (III)

$$Mo_3S_7(DTC)_4 \quad (II)$$

$$Mo_3S_4(DTC)_4 \quad (III)$$

Where the DTC is a dithiocarbamate ($R^3R^4NCS_2$) and $R^3$ and $R^4$ is a hydrocarbon containing from 1 to 25 carbon atoms or $R^3$ and $R^4$ is a hydrocarbon with an ether linkage(s) containing from 1 to 5 oxygen atoms and 1 to 25 carbon atoms. $R^3$ and $R^4$ can be the same or different.

(3) Molybdenum dithiophosphate compounds of the structure (IV)

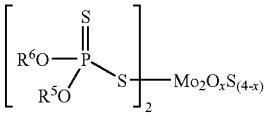

(IV)

where x=0 to 4

Where the $(R^5O)(R^6O)PS_2$ is a dithiophosphate, (DTP) and $R^5$ and $R^6$ is a hydrocarbon containing from 1 to 25 carbon atoms or $R^5$ and $R^6$ is a hydrocarbon with an ether linkage(s) containing from 1 to 5 oxygen atoms and 1 to 25 carbon atoms. $R^5$ and $R^6$ can be the same or different. Commercial examples include MOLYVAN® L from R. T. Vanderbilt Company, and Sakuralube® 300, from Adeka Co.

(4) Oil soluble molybdenum compounds prepared from a molybdenum source such as ammonium molybdates, alkali and alkaline earth metal molybdates, molybdenum trioxide, and molybdenum acetylacetonates and an active hydrogen compound such as alcohols and polyols, primary and secondary amines and polyamines, phenols, ketones, anilines, etc. can be used in combination with the diarylamines in this invention. Some examples include:

(a) Glycol molybdate complexes as described by Price et al in U.S. Pat. No. 3,285,942

(b) Overbased alkali metal and alkaline earth metal sulfonates, phenates and salicylate compositions containing molybdenum such as those claimed by Hunt et al. in U.S. Pat. No. 4,832,857. The molybdenum containing overbased alkaline earth metal and alkali metal sulfonates, phenates, and salicylates are prepared by a process which comprises:

(i) Introducing into a reaction a compound selected from the group consisting of a sulfonate, a phenate, and a salicylate where the compound is an overbased alkaline earth or alkali metal compound;

(ii) Adding to the reactor a solvent to solubilize the compound and to form a mixture A;

(iii) Heating mixture A to an elevated temperature of 120° F. or less;

(iv) Preparing an aqueous solution of a molybdenum compound at a temperature of 120° F. or less;

(v) Adding the aqueous solution of the molybdenum compound to mixture A with stirring during a period of about 15 minutes or less to form a mixture B;

(vi) Adding mixture B containing the molybdenum compound to a non-polar compound at a temperature of 220° F. or greater within a period of up to 40 minutes, resulting in mixture C. During the addition the temperature is at least 220° F.;

(vii) Driving off the water and the non-polar compound overhead by increasing temperature mixture C containing the molybdenum compound to about 240° F. to about 300° F. to obtain a water-free composition;

(viii) Adding additional quantity of a non-polar compound to said water-free composition to dilute said composition to clarify said composition by filtration or centrifugation;

(ix) Heating the clarified composition to a temperature of from about 300° F. to about 400° F. to remove solvent and non-polar compound and to recover the product comprising an overbased molybdenum-containing alkaline earth metal or alkali metal compound.

(5) Molybdenum complexes prepared by reacting a fatty oil, a diethanolamine and a molybdenum source as described by Rowan et al in U.S. Pat. No. 4,889,647

(6) Molybdenum containing compounds prepared from fatty acids and 2-(2-aminoethyl)aminoethanol as described by Karol in U.S. Pat. No. 5,137,647

(7) Overbased molybdenum complexes prepared from amines, diamines, alkoxylated amines, glycols and polyols as described by Gallo et in U.S. Pat. No. 5,143,633.

(8) 2,4-Heteroatom substituted-molybdena-3,3-dioxacycloalkanes as described by Karol in U.S. Pat. No. 5,412,130.

(9) Oil-soluble molybdenum complexes comprising the reaction products of fatty oils, a mono-alkylated diamine, and a molybdenum source as described by Gatto in U.S. Pat. No. 6,509,303.

(10) Molybdenum salts such as the carboxylates are a preferred group of molybdenum compounds. They may be salts of the same anion or mixed salts, meaning that they are formed from more than one type of acid. Illustrative of suitable anions there can be mentioned chloride, carboxylate, nitrate, sulfonate, or any other anion.

The molybdenum carboxylates may be derived from any organic carboxylic acid. The molybdenum carboxylate is preferably that of a monocarboxylic acid such as that having from about 4 to 30 carbon atoms. Such acids can be hydrocarbon aliphatic, alicyclic, or aromatic carboxylic acids. Monocarboxylic acids such as those of aliphatic acids having about 4 to 18 carbon atoms are preferred, particularly those having an alkyl group of about 6 to 18 carbon atoms. The alicyclic acids may generally contain from 4 to 12 carbon atoms. The aromatic acids may generally contain one or two fused rings and contain from 7 to 14 carbon atoms wherein the carboxyl group may or may not be attached to the ring. The carboxylic acid can be a saturated or unsaturated fatty acid having from about 4 to 18 carbon atoms. Examples of some carboxylic acids that may be used m prepare the molybdenum carboxylates include: butyric acid; valeric acid; caproic acid heptanoic acid; cyclohexanecarboxylic acid; cyclodecanoic acid; naphthenic acid; phenyl acetic acid; 2-methylhexanoic acid; 2-ethylhexanoic acid; suberic acid; octanoic acid; nonanoic acid; decanoic acid; undecanoic acid; lauric acid, tridecanoic acid; myristic acid; pentadecanoic acid; palmitic acid; linolenic acid; heptadecanoic acid; stearic acid; oleic acid; nonadecanoic acid; eicosanoic acid; heneicosanoic acid; docosanoic acid; and erucic acid.

A number of methods have been reported in the literature for preparing the molybdenum carboxylates, e.g., U.S. Pat. No. 4,593,012 to Usui and U.S. Pat. No. 3,578,690 to Becker. The Usui patent describes the production of hydrocarbon soluble salts (molybdenyl carboxylates) by reaction of an ammonium molybdate with a carboxylic acid in the presence of an organic amine at specified elevated temperatures while removing water, U.S. Pat. No. 3,578,690 prepares its molybdenum carboxylates by reacting molybdenum oxide, molybdenum halide, alkali earth molybdate, alkaline earth molybdate, ammonium molybdate or mixtures of molybdenum sources with carboxylic acids at elevated temperatures and with removal of water.

The exact composition of the oil soluble molybdenum carboxylates can vary. Most of the literature refers to these compounds as molybdenum carboxylates. They have also been referred to as molybdenum carboxylate salts, molybdenyl ($MoO_2^{2+}$) carboxylates and molybdenyl carboxylate salts, molybdenum carboxylic acid salts, and molybdenum salts of carboxylic acids.

(11) Other Molybdenum compounds. Other molybdenum compounds that can be utilized include molybdenum-containing dispersants as taught in U.S. Pat. No. 6,962,896, molybdenum-containing viscosity index (VI) modifiers, amine molybdates as in U.S. Pat. Nos. 5,858,931 and 6,329,327 to Tanaka, et al., the commercially available Sakuralube® 700 and Sakuralube® 710 from Adeka Co., and organo-imido molybdenum complexes as in U.S. Pat. No. 7,229,951 to Migdal, et al.

(12). New molybdenum compounds. New molybdenum compounds are set forth in co-pending U.S. Ser. No. 12/041,130, filed simultaneously herewith, assigned to the present assignee, and claiming benefit of the same provisional applications as the present invention.

Some of the novel molybdenum compounds used in this invention are the reaction products of a (a) hindered amine, (b) molybdenum source such as $MoO_3$, and one of (c)(i) water, (ii) a diol and water, and (iii) the reaction of product of a fatty oil and multifunctional amine, and water. A multifunctional amine is defined here as an amine containing two or more amine or hydroxyl functional groups, and may be for example 1-(2-aminoethyl)-aminoethanol or isodecyloxypropyl-1,3-diaminopropane, and preferably diethanolamine.

The reagents are added and heated to a temperature between 60 and 150° C. for a period of 1 to 6 hours. After the period of reaction, water is removed by distillation and vacuum stripping, revealing a yellow to red product. A specific chemical composition cannot be assigned to the new material, but from infrared spectroscopy is expected to contain a cis-dioxo Mo structure, indicative of a Mo(VI) complex.

Hindered Amine

The hindered amines used with this invention are of many types, with two types predominating, the pyrimidines and piperidines. These are all described in great detail below, and in U.S. Pat. Nos. 5,073,278, 5,273,669, and 5,268,113. Preferred hindered amines include 4-stearoyloxy-2,2,6,6-tetramethylpiperidine and dodecyl-N-(2,2,6,6,-tetramethyl-4-piperidinyl)succinate, sold under the trade names Cyasorb® UV-3853 and Cyasorb® UV-3581 from Cytec, di(2,2,6,6-tetramethylpiperidin-4-yl)sebacate and di(1,2,2,6,6-pentamethylpiperidin-4-yl)sebacate, sold as Songlight® 7700 and Songlight® 2920LQ from Songwon, and bis(1-octyloxy-2,2,6,-tetramethyl-4-piperidyl)sebacate, sold as Tinuvin® 123 by Ciba.

Molybdenum Source

Examples of molybdenum sources that can be used in this invention include a metal salt of molybdic acid, ammonium molybdate, or molybdenum trioxide.

Diols

The diols useful in this invention have the generalized structure (XV), (XV)

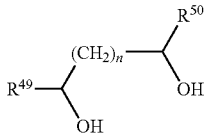

n=0 to 12 where $R^{49}$ and $R^{50}$ is hydrogen or a hydrocarbon with between 1 and 25 carbon atoms. Examples of diols that can be used in this invention include Fatty vicinal diols such as those available from Ashland Oil under the general trade designation Adol 114 and Adol 158. The former is derived from a straight chain alpha olefin fraction of $C_{11}$-$C_{14}$, and the latter is derived from a $C_{15}$-$C_{18}$ fraction. Preferred diols are 2-ethyl-1,3-hexanediol and 1,2-dodecanediol. Glycols are also included.

Fatty Oils

Fatty oils that can be used in this invention include; coconut oil, rapeseed oil, palm kernel oil, corn oil, tall oil, or any triglyceride oil.

Tungsten Compounds

The tungsten compounds that can be used with this invention include amine salts of tungsten as described in U.S. Patent Applications 20040214731 and 20070042917, which are hereby incorporated by reference.

Tungsten dithiophosphates (V) and dithiocarbamates (VI) can also be used as described in U.S. Pat. Nos. 4,529,526, and 4,266,945, where $R^7$, $R^8$, $R^9$, and $R^{10}$ are hydrocarbons containing from 1 to 30 carbon atoms, $R^7$ and $R^8$ being the same or different, and $R^9$ and $R^{10}$ being the same or different.

(V)

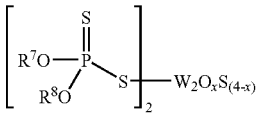

(VI)

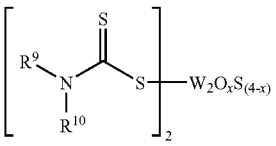

where x=0 to 4

Additionally, it is expected that novel tungsten compounds prepared by reaction with a hindered amine in analogous fashion with the novel molybdenum compounds in section (12) above will also exhibit synergy when combined in a lubricating oil composition with a hindered amine, and optionally a diarylamine.

Other Metals

Other oil-soluble metal compounds that have been useful to this invention include compounds of titanium and boron. Of these, of most importance are titanium alkoxides such as titanium isopropoxide, and borate esters. For titanium compounds, the preferred range in a lubricating composition is about 50-2000 ppm titanium, and for boron compounds, about 50-100 ppm boron.

Hindered Amines

The hindered amines used in this invention are of many types, with three types predominating: the pyrimidines, piperidines and stable nitroxide compounds. Many more are described in the book "Nitrones, Nitronates, and Nitroxides", E. Breuer, et al., 1989, John Wiley & Sons. The hindered amines are also known as HALS (hindered amine light stabilizers) and are a special type of amine capable of antioxidant behavior. They are used extensively in the plastics industry to retard photochemical degradation, but their use in lubricants has been limited.

1. Pyrimidine Compounds

Pyrimidine compounds are of the substituted tetrahydro type and include the general structure of a 2,3,4,5 tetrahydropyrimidine as given below (VII), and described by Volodarsky, et al. in U.S. Pat. No. 5,847,035, and by Alink in U.S. Pat. No. 4,085,104.

(VII)

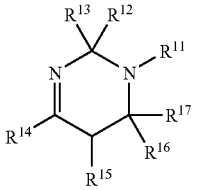

$R^{11}$ is H, O, or a hydrocarbon from 1 to 25 carbon atoms, or an alkoxy radical with the oxygen bound to the nitrogen with the alkyl portion containing 1 to 25 carbon atoms. $R^{12}$, $R^{13}$, $R^{14}$, $R^{15}$, $R^{16}$ and $R^{17}$ are hydrocarbons with 1 to 25 carbon atoms each. Most preferably, $R^{12}$, $R^{13}$, $R^{16}$, and $R^{17}$ are methyls.

Other pyrimidine compounds that can are of the hexahydro type, (VIII)

(VIII)

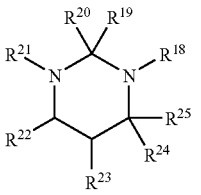

$R^{18}$ and $R^{21}$ are H, O, or a hydrocarbon from 1 to 25 carbon atoms, or an alkoxy radical with the oxygen bound to the nitrogen with the alkyl portion containing 1 to 25 carbon atoms. $R^{19}R^{20}$, $R^{21}$, $R^{22}$, $R^{23}R^{24}$ and $R^{25}$ are hydrocarbons with 1 to 25 carbon atoms each. Most preferably, $R^{19}$, $R^{20}$, $R^{24}$, and $R^{25}$ are methyls.

2. Piperidine Compounds

The piperidine compounds used in this invention are described by Schumacher, et al., U.S. Pat. No. 5,073,278 and by Evans in U.S. Pat. No. 5,268,113. These compounds have the general formula (IX);

(IX)

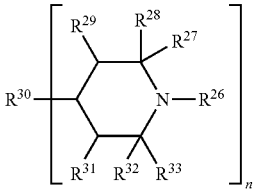

where $R^{26}$ is H, O or a hydrocarbon from 1 to 25 carbon atoms, an alkoxy radical with the oxygen bound to the nitrogen with the alkyl portion containing 1 to 25 carbon atoms, or a COR group, the R being a hydrocarbon containing from 1 to 25 carbon atoms, $R^{27}$, $R^{28}$, $R^{32}$, $R^{33}$ are hydrocarbons with 1 to 25 carbon atoms, $R^{29}$, $R^{31}$ are H or hydrocarbons with 1 to 25 carbon atoms. Most preferably $R^{27}$, $R^{28}R^{32}$ and $R^{33}$ are methyls.

when n=1, $R^{30}$ is OH, H, O, $NH_2$, $NR_2$ where R is a hydrocarbon with 1 to 25 carbon atoms, an ester group $O_2CR$ where R is a hydrocarbon with 1 to 25 carbon atoms, or a succinimide group. When n=2, $R^{30}$ is the diacyl radical of an aliphatic dicarboxylic acid having 4 to 12 carbon atoms.

Examples of hindered amines based upon piperidine include 4-hydroxy-2,2,6,6-tetramethylpiperidine, 1-allyl-4-hydroxy-2,2,6,6-tetramethylpiperidine, 1-benzyl-4-hydroxy-2,2,6,6-tetramethylpiperidine, 1-(4-tert-butylbut-2-enyl)-4-hydroxy-2,2,6,6-tetramethylpiperidine, 4-stearoyloxy-2,2,6,6-tetramethylpiperidine, 1-ethyl-4-salicyloyloxy-2,2,6,6-tetramethylpiperidine, 4-methacryloyloxy-1,2,2,6,6-pentamethylpiperidine, 1,2,2,6,6-pentamethylpiperidin-4-yl.-(3,5-di-tert-butyl-4-hydroxyphenyl)propionate, di(1-benzyl-2,2,6,6-tetramethylpiperidin-4-yl)maleate, di(2,2,6,6-tetramethylpiperidin-4-yl)succinate, di(2,2,6,6-tetramethylpiperidin-4-yl)glutarate, di(2,2,6,6-tetramethylpiperidin-4-yl)adipate, di(2,2,6,6-tetramethylpiperidin-4-yl)sebacate, di(1,2,2,6,6-pentamethylpiperidin-4-yl)sebacate, di(1,2,3,6-tetramethyl-2,6-diethylpiperidin-4-yl)sebacate, di(1-allyl-2,2,6,6-tetramethylpiperidin-4-yl)phthalate, 1-hydroxy-4-.beta.-cyanoethoxy-2,2,6,6-tetramethylpiperidine, 1-acetyl-2,2,6,6-tetramethylpiperidin-4-yl acetate, tri(2,2,6,6-tetramethylpiperidin-4-yl) trimellitate, 1-acryloyl-4-benzyloxy-2,2,6,6-tetramethylpiperidine, di(2,2,6,6-tetramethylpiperidin-4-yl)diethylmalonate, di(1,2,2,6,6-pentamethylpiperidin-4-yl) dibutylmalonate, di(1,2,2,6,6-pentamethylpiperidin-4-yl)butyl(3,5-di-tert-butyl-4-hydroxybenzyl)malonate, di(1-octyloxy-2,2,6,6-tetramethylpiperidin-4-yl)sebacate, di(1-cyclohexyloxy-2,2,6,6-tetramethylpiperidin-4-yl)sebacate, hexane-1',6'-bis(4-carbamoyloxy-1-n-butyl-2,2,6,6-tetramethylpiperidine), toluene-2',4'-bis(4-carbamoyloxy-1-n-propyl-2,2,6,6-tetramethylpiperidine), dimethyl-bis(2,2,6,6-tetramethylpiperidin-4-oxy)silane, phenyl-tris(2,2,6,6-tetramethylpiperidin-4-oxy)silane, tris(1-propyl-2,2,6,6-tetramethylpiperidin-4-yl)phosphate, tris(1-propyl-2,2,6,6-tetramethylpiperidin-4-yl)phosphate, phenyl[bis(1,2,2,6,6-pentamethylpiperidin-4-yl)]phosphonate, 4-hydroxy-1,2,2,6,6-pentamethylpiperidine, 4-hydroxy-N-hydroxyethyl-2,2,6,6-tetramethylpiperidine, 4-hydroxy-N-(2-hydroxypropyl)-2,2,6,6-tetramethylpiperidine, 1-glycidyl-4-hydroxy-2,2,6,6-tetramethylpiperidine, dodecyl-N-(2,2,6,6,-tetramethyl-4-piperidinyl)succinate.

Most useful in this invention are the 2,2,6,6-tetramethylpiperidines, 1,2,2,6,6-pentaalkylpiperidines, 1-oxo-2,2,6,6-tetramethylpiperidines, and 1-alkoxy-2,2,6,6-tetramethylpiperidines.

3. Polymers Containing Hindered Amines

Polymeric 2,2,6,6-tetraalkylpiperidines and 1,2,2,6,6-pentaalkylpiperidines are also prevalent and may be used in this formulation. The polymeric compounds used in this invention are described by Schumacher, et al., U.S. Pat. No. 5,073,278, by Evans et al. in U.S. Pat. No. 5,268,113, and by Kazmierzak et al. in U.S. Pat. No. 4,857,595. There are several kinds of polymeric piperidine compounds available. Commercially available examples include Tinuvin® 622 from Ciba and Songlight® 9440 from Songwon.

4. Other Hindered Amines

Another type of hindered amine has been disclosed in U.S. Pat. No. 5,098,944 and describes hindered amines of the type shown in general formula (XI).

(XI)

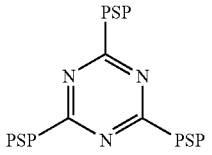

Wherein PSP represents a substituent derived from a cyclic amine represented by a structure selected from the group in general formulae (XII)

(XII)

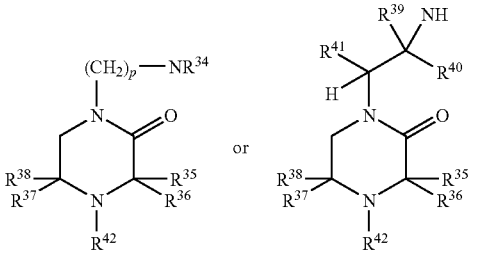

wherein PSP represents a substituent derived from a cyclic amine represented by a structure selected from the group consisting of wherein $R^{34}$ represents $C_1$-$C_{24}$ alkyl, $C_5$-$C_{20}$ cycloalkyl $C_7$-$C_{20}$ aralkyl or alkaryl, $C_1$-$C_{24}$ aminoalkyl, or $C_6$-$C_{20}$ aminocycloalkyl; $R^{35}$, $R^{36}$, $R^{37}$, and $R^{38}$ independently represent $C_1$-$C_{24}$ alkyl; and $R^{35}$ with $R^{36}$, or $R^{37}$ with $R^{38}$ are cyclizable to $C_5$-$C_{12}$ cycloalkyl including the $C_3$ and $C_5$ atoms respectively, of the piperazin-2-one ring; $R^{39}$ and $R^{40}$ independently represent $C_1$-$C_{24}$ alkyl, and polymethylene having from 4 to 7 carbonatoms which are cyclizable; $R^{41}$ represents H, $C_1$-$C_6$ alkyl, and phenyl; $R^{42}$ represents $C_1$-$C_{25}$ alkyl, H, or O, or alkoxy with a hydrocarbon chain between 1 and 25 carbon atoms; and, p represents an integer in the range from 2 to about 10.

5. Hindered Amine Salts

Virtually all of the hindered amines listed above are basic and will readily form ammonium salts. Common anions for the ammonium salt includes sulfonates, petroleum sulfonates, carboxylates, naphthenates, carbonates, sulfates, sulfites, phosphates, phosphinates, phosphites, chloride, bromide, and iodide, or any anionic material that will give the ammonium salt solubility in the lubricant.

Diarylamines

The diarylamines used in this invention are of the type $Ar_2NR$. Since these are well known antioxidants in the art, there is no restriction on the type of diarylamines used in this invention, although there is the requirement of solubility in the lubricating composition.

(XIII)

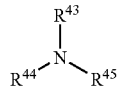

The alkylated diphenylamines are well known antioxidants and there is no particular restriction on the type of secondary diarylamine used in the invention. Preferably, the secondary diarylamine antioxidant has the general formula (X) where $R^{43}$ and $R^{44}$ each independently represents a substituted or unsubstituted aryl group having from 6 to 30 carbon atoms. $R^{45}$ represents either a H atom or an alkyl group containing from 1 to 30 carbon atoms. Illustrative of substituents for the aryl there can be mentioned aliphatic hydrocarbon groups such as alkyl having from about 1 to 20 carbon atoms, hydroxy, carboxyl or nitro, e.g., an alkaryl group having from 7 to 20 carbon atoms in the alkyl group. The aryl is preferably substituted or unsubstituted phenyl or naphthyl, particularly wherein one or both of the aryl groups are substituted with an alkyl such as one having from 4 to 18 carbon atoms. $R^{45}$ can be either H or alkyl from 1 to 30 carbon atoms. The alkylated diphenylamines used in this invention can be of a structure other than that shown in the above formula which shows but one nitrogen atom in the molecule. Thus, the alkylated diphenylamine can be of a different structure provided that at least one nitrogen has 2 aryl groups attached thereto, e.g., as in the case of various diamines having a secondary nitrogen atom as well as two aryls on one of the nitrogens. The alkylated diphenylamines used in this invention preferably have antioxidant properties in lubricating oils, even in the absence of the molybdenum compound.

Examples of some alkylated diphenylamines that may be used in this invention include: diphenyl amine, 3-hydroxydiphenylamine; N-phenyl-1,2-phenylened-amine; N-phenyl-1,4-phenylenediamine; dibutyldiphenylamine; dioctyldiphenylamine; dinonyldiphenylamine; phenyl-alpha-naphthylamine; phenyl-beta-naphthylamine; diheptyldiphenylamine; and p-oriented styrenated diphenylamine.

Phenothiazines

Phenothiazines are another class of diarylamines with the general structure (XIV), (XIV)

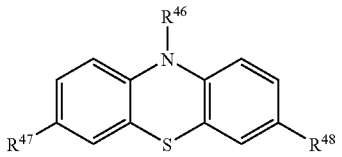

Where $R^{46}$ is H, or an alkyl from 1 to 30 carbon atoms, and $R^{47}$ and $R^{48}$ are alkyl from 1 to 30 carbon atoms Lubricating Oil Compositions The lubricating oil compositions of this invention can be prepared by adding the molybdenum, tungsten or other metal-containing additive to a lubricating oil basestock with an oil-soluble hindered amine. The metal-containing additive should be sufficient to provide from 1 to 2,000 ppm metal in the composition, and the hindered amine should be added in amount sufficient to provide from 1 to 20,000 ppm (0.01 to 2 wt %) in the lubricating oil.

In another embodiment, a lubricant oil combination of this invention can be prepared by adding the metal-containing additive to a basestock with an oil-soluble hindered amine and an oil-soluble diarylamine, with the amounts of the metal and hindered amine as above, and diarylamine added to provide from 1 to 20,000 ppm thereof in the lubricating oil.

Other Additives

In addition, other additives can be added to the lubricating compositions described above. These include one or more of the following components:

- Other antioxidants, including phenols, hindered phenols, hindered bisphenols, sulfurized phenols, sulfurized olefins, alkyl sulfides and disulfides, dialkyl dithiocarbamates, dithiocarbamate esters, such as VANLUBE® 7723 sold by the R. T. Vanderbilt Company, zinc dihydrocarbyl dithiosphosphates, zinc dithiocarbamates. A more complete list of useful phenols can be found in U.S. Pat. No. 5,073,278 to Schumacher et al.
- Antiwear additives, including zinc dihydrocarbyl dithiophosphates, tricresol phosphate, diaryl phosphate, sulfurized fats and sulfurized terpenes. Dispersants, including polymethacrylates, styrenemaleic ester copolymers, substituted succinamides, polyamine succinamides, polyhydroxy succinic esters, substituted Mannich bases, and substituted triazoles.
- Detergents, including neutral and overbased alkali and alkaline earth metal sulfonates, neutral and overbased alkali and alkine earth metal phenates, sulfurized phenates, overbased phosphonates, and thiophosphonates.
- Viscosity index improvers, including polyacrylates, polymethacrylates, vinylpyrrolidone/methacrylate copolymers, polyvinylpyrrolidones, polybutene, olefin copolymers, styrene/acrylate copolymers.
- Pour point depressants, including polymethacrylate and alkylated naphthalene derivatives.

EXAMPLE 1

Preparation of Mo compound (KJC-555-163)

Into a 500 mL round-bottomed flask was placed 15.0 g of $MoO_3$, 15.0 g water, 100 g of a reaction product of coconut oil (1 part) and diethanolamine (2.7 parts), and 40 g of Tinuven®123, a Ciba product with the chemical name bis-(1-octyloxy-2,2,6,6-tetramethyl-4-piperidyl)sebacate. The mixture was stirred and heated to 80° C. for 3 hours. An aspirator vacuum was then placed on the flask and heated for a period of 2 hours with the loss of water. The reaction was cooled somewhat and filtered hot through Celite, revealing an oily, reddish product containing 5.8% molybdenum.

EXAMPLE 2

Preparation of novel Mo Compound (KJC-555-171)

Into a 500 mL round-bottomed flask was placed 15.0 g of $MoO_3$, 15.0 g water, 62.5 g of 2-ethyl-1,3-hexanediol, and 54.6 g of Cyasorb® UV-3853, a hindered amine with the name 4-piperidol-2,2,6,6-tetremethyl-RPW stearin (fatty acids mixture). The mixture was stirred at 80° C. for 1 hour, then heated under vacuum for 1 hour. 10.36 g of a mineral oil was added, and then the mixture was filtered through Celite to give an oily, pale reddish product containing 7.7% Mo.

EXAMPLE 3

Preparation of novel Mo Compound (KJC-555-176)

Into a 500 mL round-bottomed flask was placed 15.0 g of $MoO_3$, 15.0 g water, 90.5 g of a reaction product of coconut oil (1 part) and diethanolamine (2.7 parts), and 54.6 g of Cyasorb® UV-3853. The mixture was heated at 80° C. for 1 hour, then heated under vacuum for 70 minutes. 15.0 g of a mineral oil was then added to give an oily reddish product containing 5.9% Mo.

EXAMPLE 4

Lubricant Compositions Containing Hindered Amine and Molybdenum Compound

Pressurized differential scanning calorimetry (PDSC) was performed according to ASTM Test Method D1686 on the products of Examples 2 and 3, also called KJC-555-171, and KJC-555-176 respectively. These tests were performed on a lubricant composition comprising a polyalphaolefin oil, Durasyn® 166 from BP, and Infineum® C9268, a crankcase dispersant containing 1.2% Nitrogen from Infineum. Also provided in the lubricant composition was N-methyl hindered amine Songlight® 2920LQ, (chemically bis(1,2,2,6,6-pentamethyl-1-piperidinyl)sebacate) and the aforementioned Cyasorb UV-3853. The molybdenum containing compounds were added to the lubricating compositions to give 700 ppm of Mo. The test is performed by blending and adding the ingredients into a DSC cell, heating the cell to 210° C., then pressurizing with 500 psi of oxygen. What is measured is the oxidation induction time (OIT), which is the time takes to observe an exothermic release of heat. The longer the OIT the greater the oxidative stability of the oil blend. The results are shown in Table I labeled as "minutes to induction".

The results clearly show a synergy between the molybdenum compound and the hindered amine utilized. The oxidation induction times were significantly increased when both the hindered amine and the molybdenum compound were present, than when separate.

TABLE I

PDSC Induction Times for Motor Oil Blends

| | Wt % Additive (ppm metal) | | | | |
|---|---|---|---|---|---|
| (Ex. 2) KJC-555-171 | 0.91 (700) | | 0.91 (700) | | |
| Songlight 2920LQ | | | | 1.5 | 1.5 |
| Cyasorb UV-3853 | | 1.5 | 1.5 | | |

TABLE I-continued

| PDSC Induction Times for Motor Oil Blends | | | | | | |
|---|---|---|---|---|---|---|
| | Wt % Additive (ppm metal) | | | | | |
| (Ex. 3) KJC-555-176 | | | | 1.19 (700) | | 1.19 (700) |
| Infineum C9268 | 3.90 | 3.90 | 3.90 | 3.90 | 3.9 | 3.9 |
| Durasyn 166 | 95.19 | 94.6 | 93.69 | 94.91 | 94.6 | 93.41 |
| Minutes to induction | 27.4 | 2.7 | 73.7 | 20.4 | 4.7 | 79.3 |

EXAMPLE 5

Lubricant Compositions Containing Alkylated Diphenylamine and Molybdenum Compound Lubricant compositions containing the combination of alkylated diphenylamine, and the products of Examples 2 and 3 were prepared and PDSC (ASTM D1686) was performed as in Example 4. The molybdenum containing compounds were added to the lubricating compositions to give 700 ppm of Mo. The results are given in Table II.

Clearly there is a strong synergism observed when the combination of the alkylated diphenylamine and the reaction products of Examples 2 or 3 is used.

TABLE II

| PDSC Induction Times for Motor Oil Blends | | | | | |
|---|---|---|---|---|---|
| | Wt % Additive (ppm metal) | | | | |
| Vanlube SL | 1.5 | | 1.5 | 1.5 | |
| (Ex. 2) KJC-555-171 | | 0.91 (700) | 0.91 (700) | | |
| (Ex. 3) KJC-555-176 | | | | 1.19 (700) | 1.19 (700) |
| Infineum C9268 | 3.94 | 3.90 | 3.90 | 3.90 | 3.90 |
| Durasyn 166 | 94.56 | 95.19 | 93.69 | 93.41 | 94.91 |
| Minutes to induction | 5.2 | 27.4 | 58.9 | 64.3 | 20.4 |

EXAMPLE 6

Lubricant Compositions Containing Hindered Amine, Alkylated Diphenylamine and Molybdenum Compound Lubricant compositions containing the combination of a hindered amine, alkylated diphenylamine, and the products of Examples 2 and 3 were prepared and PDSC (ASTM D1686) was performed as in Example 4. The molybdenum containing compounds were added to the lubricating compositions to give 700 ppm of Mo. The results are given in Table III.

The induction times clearly show improvement when the three components are together as opposed to just two at the same concentrations.

TABLE III

| PDSC Induction Times for Motor Oil Blends | | | | | | | | | |
|---|---|---|---|---|---|---|---|---|---|
| | Wt % Additive (ppm metal) | | | | | | | | |
| Vanlube SL | | 1.5 | | 0.75 | 1.5 | 0.75 | | | 0.75 |
| (Ex. 2) KJC-555-171 | 0.91 (700) | 0.91 (700) | | 0.91 (700) | | | | | |
| Songlight 2920LQ | | | | | | | | 1.5 | 0.75 |
| Cyasorb UV-3853 | | | 1.5 | 0.75 | | 0.75 | | | |
| (Ex. 3) KJC-555-176 | | | | | 1.19 (700) | | 1.19 (700) | 1.19 (700) | 1.19 (700) |
| Infineum C9268 | 3.90 | 3.90 | 3.9 | 3.90 | 3.90 | 3.90 | 3.90 | 3.9 | 3.9 |
| Durasyn 166 | 95.19 | 93.69 | 94.6 | 93.69 | 93.41 | 94.6 | 94.91 | 93.41 | 93.41 |
| Minutes to induction | 27.4 | 58.9 | 2.7 | 74.3 | 64.3 | 9.6 | 20.4 | 79.3 | 81.1 |

EXAMPLE 7

Lubricant Compositions Containing a Molybdate Ester Compound with a Hindered Amine, and a Molybdate Ester Compound with a Hindered Amine and an Alkylated Diphenylamine Lubricant compositions containing the combination of hindered amine and the MOLYVAN® 855 were prepared and PDSC (ASTM D1686) was performed as in Example 4. MOLYVAN® 855 was added at an amount to give 700 ppm Mo to the lubricating composition. The results are given in Table IV.

Again a large synergy is observed when the combination of the 855 and the hindered amine is used. Three types of hindered amines were utilized: an N-R, (Songlight 2920LQ), an N-H (Cyasorb UV-3853) and an N-OR type, (Tinuvin 123). All three were found to be effective as antioxidants in combination with the molybdate ester.

Lubricant compositions containing the combination of hindered amine, alkylated diphenylamine and MOLYVAN® 855 at 700 ppm Mo were also found to have strong synergies in the PDSC (ASTM D1686), and gave longer induction times than either the alkylated diphenylamine/molybdate ester or hindered amine/molybdate ester at equal weight concentrations of the hindered amine and alkylated diphenylamine.

TABLE IV

PDSC Induction Times for Motor Oil Blends

| | Wt % Additive (ppm metal) | | | | | | | | | |
|---|---|---|---|---|---|---|---|---|---|---|
| Vanlube SL | 1.5 | | 1.5 | | 0.5 | 1.0 | | 0.75 | | 0.75 |
| Molyvan 855 | | 0.91 (700) | 0.91 (700) | 0.91 (700) | 0.91 (700) | 0.91 (700) | 0.91 (700) | 0.91 (700) | 0.91 (700) | 0.91 (700) |
| Songlight 2920LQ | | | | | | | | | 1.5 | 0.75 |
| Cyasorb UV-3853 | | | | | | | 1.5 | 0.75 | | |
| Tinuvin 123 | | | | 1.5 | 1.0 | 0.5 | | | | |
| Infineum C9268 | 4 | 3.96 | 3.9 | 3.90 | 3.90 | 3.90 | 3.90 | 3.90 | 3.90 | 3.90 |
| Durasyn 166 | 94.5 | 95.13 | 93.69 | 93.69 | 93.69 | 93.69 | 93.69 | 93.69 | 93.69 | 93.69 |
| Minutes to induction | 8.2 | 1.2 | 28 | 22.7 | 72.1 | 52.1 | 66.4 | 71.2 | 62.7 | 70.4 |

EXAMPLE 8

Lubricant Compositions Containing a Molybdenum Naphthenate Compound with a Hindered Amine, and a Molybdenum Naphthenate Compound with a Hindered Amine and an Alkylated Diphenylamine Lubricant compositions containing the combination of hindered amine and the Mo Nap-All were prepared and PDSC (ASTM D1686) was performed as in Example 4. Mo Nap-All®, is a molybdenum naphthenate compound with 6% Mo, manufactured by OMG and was added to give 700 ppm Mo to the lubricating composition. The oxidation induction time was vastly improved when the combination of the molybdenum compound and the hindered amine was employed.

Lubricant compositions containing the combination of hindered amine, alkylated diphenylamine and Mo Nap-All at 700 ppm Mo were also found to have strong synergies in the PDSC (ASTM D1686), and gave longer induction times than either the alkylated diphenylamine/Mo Nap-All or hindered amine/Mo Nap-All at equal weight concentrations of the hindered amine and alkylated diphenylamine.

TABLE V

PDSC Induction Times for Motor Oil Blends

| | Wt % additive (ppm metal) | | | |
|---|---|---|---|---|
| Mo Nap-All | 1.17 (700) | 1.17 (700) | 1.17 (700) | 1.17 (700) |
| Songlight 2920LQ | | | 1.5 | 0.75 |
| Vanlube SL | | 1.5 | | 0.75 |
| Infineum C9268 | 3.9 | 3.9 | 3.9 | 3.9 |
| Durasyn 166 | 94.9 | 93.4 | 93.4 | 93.4 |
| Minutes to induction | 0.8 | 33.2 | 44.5 | 59.7 |

EXAMPLE 9

Lubricant Compositions Containing a Molybdenum Dithiocarbamate Compound with a Hindered Amine, and a Molybdenum Dithiocarbamate Compound with a Hindered Amine and an Alkylated Diphenylamine Lubricant compositions containing the combination of hindered amine and the MOLYVAN® 822 were prepared and PDSC (ASTM D1686) was performed as in Example 4. MOLYVAN® 822, is a molybdenum dithiocarbamate compound with approximately 5% Mo, manufactured by R.T. Vanderbilt and was added to give 700 ppm Mo to the lubricating composition. The oxidation induction time was vastly improved when the combination of the molybdenum compound and the hindered amine was employed.

Lubricant compositions containing the combination of hindered amine, alkylated diphenylamine and MOLYVAN® 822 at 700 ppm Mo were also found to have strong synergies in the PDSC (ASTM D1686), and gave longer induction times than either the alkylated diphenylamine/MOLYVAN® 822 or hindered amine/MOLYVAN® 822 at equal weight concentrations of the hindered amine and alkylated diphenylamine.

TABLE VI

PDSC Induction Times for Motor Oil Blends

| | Wt % additive (ppm metal) | | | |
|---|---|---|---|---|
| Molyvan 822 | 1.52 (700) | 1.52 (700) | 1.52 (700) | 1.52 (700) |
| Songlight 2920LQ | | 1.5 | | 0.75 |
| Vanlube SL | | | 1.5 | 0.75 |
| Infineum C9268 | 3.9 | 3.9 | 3.9 | 3.9 |
| Durasyn 166 | 94.6 | 93.1 | 93.1 | 93.1 |
| Minutes to induction | 1.3 | 19.2 | 19 | 26.3 |

EXAMPLE 10

Lubricant Compositions Containing a Tungsten-Amine Compound with a Hindered Amine, and a Tungsten-Amine Compound with a Hindered Amine and an Alkylated Diphenylamine A tungsten-amine compound BT-521-197 containing 28.2% W was used and blended to give approximately 700 ppm of W in the blends. BT-521-197 is the reaction product of tungstic acid and ditridecylamine according to U.S. patent application no. 20040214731.

A PDSC test slightly modified from that used in Example 4 (ASTM D6186) was performed on the blends. Unocal® 90 was used as the base oil. Unocal® 90 is a paraffinic Group I base oil from Union Oil of California. The temperature was also 180° C.

The results clearly show a synergy between the tungsten-amine compound and the hindered amine, superior to the synergy between the Vanlube SL and the tungsten-amine compound. The results also show a synergy between the blend of the Vanblue SL, the hindered amine, and the tungsten-amine compound.

TABLE VII

| PDSC Induction Times for Motor Oil Blends | | | | | | | |
|---|---|---|---|---|---|---|---|
| | Wt % Additive (ppm metal) | | | | | | |
| Vanlube SL | | 1.5 | 1.5 | | | 0.75 | 0.75 |
| Songlight 2920 LQ | | | | 1.5 | 1.5 | 0.75 | 0.75 |
| BT-521-197 (W Complex) | 0.24 (700) | 0.24 (700) | | 0.24 (700) | | 0.24 (700) | |
| Infineum C9268 | 3.9 | 3.9 | 3.9 | 3.9 | 3.9 | 3.9 | 3.9 |
| Unocal 90 | 94.6 | 94.6 | 94.6 | 94.36 | 94.36 | 94.36 | 95.86 |
| ASTM D6186 @ 180° C. | | | | | | | |
| Minutes to Induction | 8.6 | 68 | 41.5 | 207.5 | 136.1 | 104.8 | 103 |

EXAMPLE 11

Lubricant Compositions Containing a Titanium Compound with a Hindered Amine, and a Titanium Compound with a Hindered Amine and an Alkylated Diphenylamine Titanium isopropoxide, sold under the trade name Tyzor® TPT by duPont, and containing approximately 16.8% titanium, was added at 1% to impart 1680 ppm Ti to the lubricating compositions, and PDSC was run as in Example 3(ASTM D6186). VANLUBE® 961, an octylated diphenylamine sold by R.T. Vanderbilt was used as the alkylated diphenylamine, and Songlight 2920LQ was used as the hindered amine. Results clearly show synergies between the Songlight 2920LQ and the titanium isopropoxide, as well as a synergy between the combination of the Songlight 2920LQ, the VANLUBE 961, and the titanium isopropoxide.

TABLE IX

| PDSC Induction Times for Motor Oil Blends | | | | | | |
|---|---|---|---|---|---|---|
| | Wt % Additive (ppm metal) | | | | | |
| Vanlube 289 | 1.00 (100) | | | 1.00 (100) | 1.00 (100) | 1.00 (100) |
| Songlight 2920LQ | | 1.50 | | 1.50 | | 0.75 |
| Vanlube 961 | | | 1.50 | | 1.50 | 0.75 |
| Infineum C9268 | 3.90 | 3.90 | 3.90 | 3.90 | 3.90 | 3.90 |
| Durasyn 166 | 95.10 | 94.60 | 94.60 | 93.60 | 93.60 | 93.60 |
| Minutes to induction | 0.90 | 4.30 | 8.20 | 19.60 | 12.50 | 11.90 |

TABLE VIII

| PDSC Induction Times for Motor Oil Blends | | | | | | |
|---|---|---|---|---|---|---|
| | Wt % Additive (ppm metal) | | | | | |
| Titanium isopropoxide | 1.00 (1680) | | | 1.00 (1680) | 1.00 (1680) | 1.00 (1680) |
| Songlight 2920LQ | | 1.50 | | | 1.50 | 0.75 |
| Vanlube 961 | | | 1.50 | 1.50 | | 0.75 |
| Infineum C9268 | 3.90 | 3.90 | 3.90 | 3.90 | 3.90 | 3.90 |
| Durasyn 166 | 95.10 | 94.60 | 94.60 | 93.60 | 93.60 | 93.60 |
| Minutes to induction | 1.20 | 4.30 | 8.20 | 24.60 | 64.30 | 11.90 |

EXAMPLE 12

Lubricant Compositions Containing a Boron Compound with a Hindered Amine, and a Boron Compound with a Hindered Amine and an Alkylated Diphenylamine VANLUBE® 289 a borate ester containing 1% boron, was added at 1% and PDSC was run as in Example 4 (ASTM D6186). VANLUBE® 961, an octylated diphenylamine sold by R.T. Vanderbilt was used as the alkylated diphenylamine, and Songlight 2920LQ was used as the hindered amine. Results clearly show synergies between the Songlight 2920LQ and the VANLUBE 289, as well as a synergy between the combination of the Songlight 2920LQ, the VANLUBE 961, and the VANLUBE 289.

EXAMPLE 13

Lubricant Compositions Varying the Concentrations of the Additives

Lubricant compositions were prepared at two levels of MOLYVAN® 855, 0.91% and 0.16% that correspond to 700 and 125 ppm Mo respectively. Five levels of the Songlight® 2920LQ and VANLUBE® SL, with the sum of the weight percentage being 1.5. The PDSC was performed as in Example 4, and the results are given below.

The synergies are clearly seen across a range of additive levels.

TABLE IX

PDSC Induction Times for Motor Oil Blends

| | Wt % additive (ppm metal) | | | | | | | | | |
|---|---|---|---|---|---|---|---|---|---|---|
| Molyvan 855 | 0.91 (700) | 0.91 (700) | 0.91 (700) | 0.91 (700) | 0.91 (700) | 0.16 (125) | 0.16 (125) | 0.16 (125) | 0.16 (125) | 0.16 (125) |
| VL SL | 1.50 | 1.40 | 1.00 | 0.50 | 0.00 | 1.50 | 1.40 | 1.00 | 0.50 | 0.00 |
| % Songlight 2920 LQ | 0.00 | 0.10 | 0.50 | 1.00 | 1.50 | 0.00 | 0.10 | 0.50 | 1.00 | 1.50 |
| Minutes to Induction | 28.00 | 19.10 | 59.50 | 73.10 | 62.70 | 35.40 | 28.40 | 42.40 | 49.90 | 48.60 |

We claim:

1. A lubricant composition which comprises at least 50 wt % of a lubricating base oil and an oil-soluble metal compound providing between about 100 and about 1680 parts per million of metal to the lubricant composition, the metal compound being chosen from the group consisting of molybdenum, tungsten, titanium and boron compounds, and an oil-soluble first hindered amine providing between about 0.5 and about 1.5 wt % of oil-soluble hindered amine to the lubricant composition, wherein the first hindered amine is one or more chosen from the group consisting of:

(a) a compound of the formula

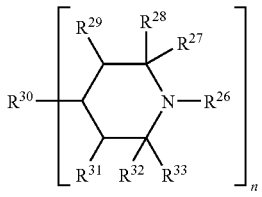

where $R^{26}$ is H, O or a hydrocarbon from 1 to 25 carbon atoms, an alkoxy radical with the oxygen bound to the nitrogen with the alkyl portion containing 1 to 25 carbon atoms, or a COR group, the R being a hydrocarbon containing from 1 to 25 carbon atoms; $R^{27}$, $R^{28}$, $R^{32}$, $R^{33}$ are hydrocarbons with 1 to 25 carbon atoms; $R^{29}$, $R^{31}$ are H or hydrocarbons with 1 to 25 carbon atoms; when n=1, $R^{30}$ is OH, H, O, $NH_2$, $NR_2$ where R is a hydrocarbon with 1 to 25 carbon atoms, an ester group $O_2CR$ where R is a hydrocarbon with 1 to 25 carbon atoms, or a succinimide group; when n=2, $R^{30}$ is the diacyl radical of an aliphatic dicarboxylic acid having 4 to 12 carbon atoms;

(b) 4-stearoyloxy-2,2,6,6-tetramethylpiperidine, (c) di(2,2,6,6-tetramethylpiperidin-4-yl) sebacate, (d) di(1,2,2,6,6-pentamethylpiperidin-4-yl) sebacate, (e) bis (1-octyloxy-2,2,6,-tetramethyl-4-piperidyl) sebacate (f) polymer-bound piperidine compound, (g) a compound of the group consisting of 2,2,6,6-tetramethylpiperidines, 1,2,2,6,6-pentamethylpiperidines, 1-oxo-2,2,6,6-tetramethylpiperidines, and 1-alkoxy-2,2,6,6-tetramethylpiperidines, and (h) a compound of the group consisting of di(1,2,2,6,6-pentamethylpiperidin-4-yl) sebacate, 4-stearoyloxy-2,2,6,6-tetramethylpiperidine, di(,2,2,6,6-tetramethylpiperidin-4-yl) sebacate and bis (1-octyloxy-2,2,6,-tetramethyl-4-piperidyl) sebacate.

2. The lubricant composition according to claim 1, further comprising an oil-soluble diarylamine providing between about 0.5 and about 1.5 wt % of oil-soluble diarylamine to the lubricant composition.

3. The lubricating composition according to claim 1, wherein the oil-soluble metal compound is an oil-soluble molybdenum compound.

4. The lubricating composition according to claim 1, wherein the oil-soluble metal compound is an oil-soluble tungsten compound.

5. The lubricating composition according to claim 3, wherein the oil-soluble molybdenum compound is one or more chosen from the group consisting of:

(i) a molybdenum dithiocarbamate compound of the formula:

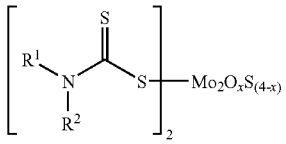

where x=0 to 4, and where $(R^1R^2NCS_2)$ is a dithiocarbamate (DTC) where $R^1$ and $R^2$ is a hydrocarbon containing from 1 to 25 carbon atoms or $R^1$ and $R^2$ is a hydrocarbon with an ether linkage(s) containing from 1 to 5 oxygen atoms and 1 to 25 carbon atoms, $R^1$ and $R^2$ being the same or different, (ii) a molybdenum dithiocarbamate compound of the formulas:

$Mo_3S_7(DTC)_4$ or $Mo_3S_4(DTC)_4$ where the DTC is a dithiocarbamate $(R^3R^4NCS_2)$ and $R^3$ and $R^4$ is a hydrocarbon containing from 1 to 25 carbon atoms or $R^3$ and $R^4$ is a hydrocarbon with an ether linkage(s) containing from 1 to 5 oxygen atoms and 1 to 25 carbon atoms, $R^3$ and $R^4$ being the same or different, (iii) a molybdenum dithiophosphate compound of the formula:

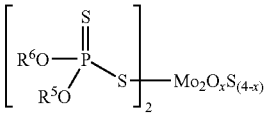

where x=0 to 4, and where the $(R^5O)(R^6O)PS_2$ is a dithiophosphate (DTP) and $R^5$ and $R^6$ is a hydrocarbon containing from 1 to 25 carbon atoms or $R^5$ and $R^6$ is a hydrocarbon with an ether linkage(s) containing from 1 to 5 oxygen atoms and 1 to 25 carbon atoms, $R^5$ and $R^6$ being the same or different, (iv) a glycol molybdenum complex, (v) an organic amide molybdenum complex, (vi) an amine molybdenum complex, (vii) a molybdenum complex obtained by reacting a fatty oil, diethanolamine and molybdenum source, (viii) a reaction product of a molybdenum source with a fatty acid and a 2-(2-aminoethyl)aminoethanol, (ix) a reaction product of a fatty oil, a mono-alkylated diamine, and a molybdenum source, and (x) one or more of the group consisting of molybdenum naphthenate, molybdenum octoate and molybdenum 2-ethylhexanoate.

6. The lubricating composition according to claim 4, wherein the oil-soluble tungsten compound is chosen from one or more of the group consisting of:

(i) the reaction product of an amine with a tungsten source, the tungsten source being selected from the group consisting of tungsten trioxide, tungstic acid and an alkali metal tungstate, and the amine is of the formula $R^{51}R^{52}R^{53}N$ wherein $R^{51}$, $R^{52}$, and $R^{53}$ may be identical or different, and are selected from the group consisting of hydrogen and an alkyl group containing between 1 and 30 carbon atoms, (ii) a tungsten dithiophosphate of the formula:

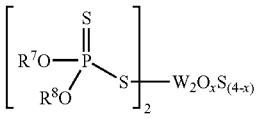

where x=0 to 4, and $R^7$, and $R^8$ are hydrocarbons containing from 1 to 30 carbon atoms, $R^7$ and $R^8$ being the same or different, and (iii) a tungsten dithiocarbamate of the formula:

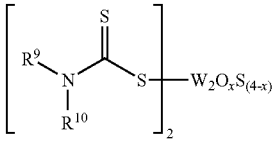

where x=0 to 4, and $R^9$ and $R^{10}$ are hydrocarbons containing from 1 to 30 carbon atoms, $R^9$ and $R^{10}$ being the same or different.

7. A lubricant composition which comprises at least 50 wt % of a lubricating base oil and an oil-soluble molybdenum compound providing between 1 and 2,000 parts per million of molybdenum to the lubricant composition, and an oil-soluble first hindered amine providing between about 0.001 and about 2 wt % of oil-soluble hindered amine to the lubricant composition, wherein the oil-soluble molybdenum compound is a reaction product of a second hindered amine and a molybdenum source, and one of the following:

(a) water, (b) the reaction product of a fatty oil with a multifunctional amine, and water, and (c) a diol, and water; wherein the second hindered amine is one or more chosen from the group consisting of:

(a) a compound of the formula

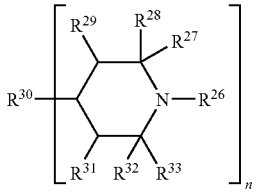

where $R^{26}$ is H, O or a hydrocarbon from 1 to 25 carbon atoms, an alkoxy radical with the oxygen bound to the nitrogen with the alkyl portion containing 1 to 25 carbon atoms, or a COR group, the R being a hydrocarbon containing from 1 to 25 carbon atoms; $R^{27}$, $R^{28}$, $R^{32}$, $R^{33}$ are hydrocarbons with 1 to 25 carbon atoms; $R^{29}$, $R^{31}$ are H or hydrocarbons with 1 to 25 carbon atoms; when n=1, $R^{30}$ is OH, H, O, $NH_2$, $NR_2$ where R is a hydrocarbon with 1 to 25 carbon atoms, an ester group $O_2CR$ where R is a hydrocarbon with 1 to 25 carbon atoms, or a succinimide group; when n=2, $R^{30}$ is the diacyl radical of an aliphatic dicarboxylic acid having 4 to 12 carbon atoms;

(b) 4-stearoyloxy-2,2,6,6-tetramethylpiperidine, (c) di(2,2,6,6-tetramethylpiperidin-4-yl) sebacate, (d) di(1,2,2,6,6-pentamethylpiperidin-4-yl) sebacate, (e) bis (1-octyloxy-2,2,6,-tetramethyl-4-piperidyl) sebacate (f) polymer-bound piperidine compound, (g) a compound of the group consisting of 2,2,6,6-tetramethylpiperidines, 1,2,2,6,6-pentamethylpiperidines, 1-oxo-2,2,6,6-tetramethylpiperidines, and 1-alkoxy-2,2,6,6-tetramethylpiperidines, and (h) a compound of the group consisting of di(1,2,2,6,6-pentamethylpiperidin-4-yl) sebacate, 4-stearoyloxy-2,2,6,6-tetramethylpiperidine, di(,2,2,6,6-tetramethylpiperidin-4-yl) sebacate and bis (1-octyloxy-2,2,6,-tetramethyl-4-piperidyl) sebacate.

8. The lubricating composition of claim 7, wherein the fatty oil is coconut oil.

9. The lubricating composition according to claim 7, wherein the diol is 2-ethyl-1,3-hexanediol or 1,2-dodecanediol.

10. The lubricating composition according to claim 7, wherein the multifunctional amine is diethanolamine.

11. The lubricating composition according to claim 2, wherein the diarylamine is of the formula:

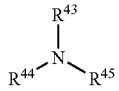

wherein $R^{43}$ and $R^{44}$ each independently represent an aryl group having from 6 to 30 carbon, atoms, and $R^{45}$ represents either a H atom or an alkyl group containing from 1 to 30 carbon atoms.

12. The lubricating composition according to claim 2, wherein at least one of said aryl groups has from 7 to 20 carbon atoms.

13. The lubricating composition according to claim 2, wherein each of the aryl groups of the amine is selected from phenyl, naphthyl, alkylphenyl and alkylnaphthyl wherein the alkyl portion has from 4 to 18 carbon atoms.

14. The lubricating composition according to claim 2, wherein both aryl groups are alkylaryl having from 7 to 20 carbon atoms.

15. The lubricating composition according to claim 1, comprising an amount of oil-soluble molybdenum or tungsten compound to provide about 125 to about 700 ppm metal in the lubricating composition.

* * * * *